US006988852B2

(12) United States Patent
Bussey, Jr. et al.

(10) Patent No.: US 6,988,852 B2
(45) Date of Patent: Jan. 24, 2006

(54) DRAINAGE ELEMENT FOR WALLS AND SEPTIC TANK SYSTEMS

(76) Inventors: Harry Bussey, Jr., 960 Cape Macro Dr., Unit 1803, Marco Island, FL (US) 33937; Harry (Buddy) Bussey, III, 4 Windy Hill, Atlantic Hills, NJ (US) 07716

( * ) Notice: Subject to any disclaimer, the term of this patent is extended or adjusted under 35 U.S.C. 154(b) by 0 days.

(21) Appl. No.: 10/984,702

(22) Filed: Nov. 9, 2004

(65) Prior Publication Data

US 2005/0063781 A1 Mar. 24, 2005

Related U.S. Application Data

(62) Division of application No. 10/211,675, filed on Aug. 2, 2002, now Pat. No. 6,857,818.

(51) Int. Cl.
*E02B 11/02* (2006.01)

(52) U.S. Cl. ..... 405/38; 405/36; 405/46; 52/169.5; 52/302.3

(58) Field of Classification Search ..... 405/36, 405/38, 43, 45, 46, 51, 302.6; 52/169.5, 52/169.14, 302.1, 302.3; 210/346, 486, 170, 210/747; 428/35.2
See application file for complete search history.

(56) References Cited

U.S. PATENT DOCUMENTS 3,441,140 A * 4/1969 Thurber et al. ..... 210/170
3,687,021 A * 8/1972 Hensley ..... 404/31
3,696,623 A * 10/1972 Heine et al. ..... 405/19
4,309,855 A * 1/1982 Pate et al. ..... 52/169.5
4,501,788 A * 2/1985 Clem ..... 405/107
4,961,982 A * 10/1990 Taylor ..... 428/91
4,986,699 A * 1/1991 Bohnhoff ..... 405/50
5,015,123 A * 5/1991 Houck et al. ..... 405/45
5,091,234 A * 2/1992 McGroarty et al. ..... 428/143
5,100,258 A * 3/1992 VanWagoner ..... 405/45
5,102,260 A * 4/1992 Horvath et al. ..... 405/50
5,287,650 A * 2/1994 Moriguchi et al. ..... 47/59 R
5,379,547 A * 1/1995 Whisenant ..... 47/79
5,381,626 A * 1/1995 Sherfield ..... 47/84
5,535,499 A * 7/1996 Houck et al. ..... 29/428
5,595,652 A * 1/1997 Rainer ..... 210/282
5,713,696 A * 2/1998 Horvath et al. ..... 405/45
6,173,483 B1 * 1/2001 Houck et al. ..... 29/407.09
6,303,033 B1 * 10/2001 Malone et al. ..... 210/282
6,440,304 B2 * 8/2002 Houck et al. ..... 210/282
6,547,493 B2 * 4/2003 Spangler et al. ..... 405/302.6
6,561,732 B1 * 5/2003 Bloomfield et al. ..... 405/43
6,851,454 B2 * 2/2005 Koerner ..... 138/105
6,857,818 B2 * 2/2005 Bussey et al. ..... 405/38
2004/0022973 A1 * 2/2004 Bussey et al. ..... 428/35.2

FOREIGN PATENT DOCUMENTS

EP 562135 * 9/1993

* cited by examiner

*Primary Examiner*—Jong-Suk (James) Lee
(74) *Attorney, Agent, or Firm*—Francis C. Hand; Carella, Byrne, Bain, etal

(57) ABSTRACT

A drainage element is constructed of loose fill elements within a casing having a first part-circumferential portion of mesh construction and a second part-circumferential portion having a porosity to prevent the passage of water. The loose fill elements are disposed in unconnected relation to each other so as to be able to migrate within the container. The openings of the mesh container allow water to pass through while retaining the loose fill elements in place. In one embodiment, a porous layer is secured to a bale shaped drainage element in order to form a sleeve to receive a perforated pipe.

15 Claims, 3 Drawing Sheets

DRAINAGE ELEMENT FOR WALLS AND SEPTIC TANK SYSTEMS

This application is a Division of Ser. No. 10/211,675, filed Aug. 2, 2002, now U.S. Pat. No. 6,857,818.

This invention relates to a drainage element for walls and for septic systems.

As is known, various types of walls, such as foundation walls, building basement walls, retaining walls and the like, are subject to contact with groundwater. In order to drain groundwater from these walls, various types of drainage systems have been employed. For example, one common method of removing groundwater from adjacent a wall is to form a trench adjacent the wall, to fill the trench with gravel and to cover the gravel with backfill. In addition, various types of pipes have been located within the gravel, or adjacent thereto, in order to convey water away from the site.

While this type of drainage system is effective, the use of gravel makes the system labor-intensive and requires the use of heavy machinery in order to move the gravel into place.

In order to avoid the use of gravel and like heavy materials to create a drainage system for walls and the like, U.S. Pat. No. 4,309,855 proposes to use water impermeable synthetic resin backing plates and a footer structure comprised of a body of beads of synthetic resin which are bonded to each other at peripheral points of contact to form a bead pack. The bead pack is also geometrically configured to define a semi-cylindrical groove or channel complementary in configuration to a perforated drainage pipe of conventional construction.

U.S. Pat. No. 5,102,260 describes a composite comprised of a compressible layer, a drainage layer and a water-permeable membrane that may be affixed to a water-proofing layer applied to a wall surface. The compressible layer is composed of expanded polystyrene of relatively low density to permit the layer to compress under pressure caused by surrounding earth material. The drainage layer is composed of beads of expanded polystyrene lightly bonded or fused together at random, touching surface locations to create void spacing that permits water and other liquids to flow through. The drainage layer has a density substantially greater than that of the compressible layer. As described, the deformation of the compressible layer and drainage layer provide a planned accommodation for a degree of horizontal deformation of the retained earth material.

U.S. Pat. No. 5,713,696 describes an elasticized geosynthetic panel that is to be positioned between a rigid retaining wall and ambient earth materials to operably compress under the horizontal stresses applied to the wall of the adjacent earth formation. The panel is composed of a drainage component, a water and gas permeable membrane and a compressible geofoam member. The drainage component is composed of beads of expanded polystyrene lightly bonded or fused together to create void spacing that permits water and other liquids to flow through the drainage layer. The compressible member is composed of an elasticized expanded polystyrene having a density of approximately two pounds per cubic foot to allow the layer to compress in response to horizontal stresses.

U.S. Pat. No. 5,100,258 describes a drainage quilt that employs drainage members composed of cubes of expanded polystyrene, chunks of old rubber tires or other non-ground polluting material and are positioned in a homogeneous fashion to create drainage paths. The drainage quilt is to be used adjacent to a drainage pipe and beneath backfill to facilitate the passage of ground water from the backfill to the drainage pipe. In addition, positioning ties extend through the surfaces of the quilt to retain the relative positioning of the drainage members. The water-permeable feature of the quilt prevents earth fines from traversing the quilt and entering a perforated drainage pipe.

U.S. Pat. No. 5,015,123 describes a preassembled unit for a sewage nitrification field having light weight plastic aggregate material enveloped and bound by a plastic sleeve around a horizontal conduit. An embodiment is also described that is formed of a plastic mesh tube that is packed with aggregate and tied off at each end without the insertion of a conduit.

It has also been known to construct a drainage element of expanded polystyrene aggregates encased within a polyethylene netting with or without a perforated corrugated plastic pipe within the aggregate for drainage purposes. However, the aggregate has been formed of rather large E-shaped elements that have a solid end wall on one end with ribs extending perpendicularly from the wall. As such, the solid wall and ribs define recesses within which water may be trapped and/or fines may become trapped. Typically, systems that have been proposed for this type of structure have required the use of at least one drainage layer with a perforated corrugated plastic pipe in order to draw off water which passes through the aggregate.

Accordingly, it is an object of the invention to provide an improved geosynthetic drainage element.

It is another object of the invention to provide a geosynthetic drainage element having enhanced water permeability.

It is an object of the invention to provide a drainage element that can be constructed in various geometric shapes and that can be easily handled by one person.

It is another object of the invention to provide a light weight drainage element that may be manually handled.

It is another object of the invention to provide drainage elements for fabricating a drainage system at a relatively low economic cost.

It is another object of the invention to provide a drainage system employing geosynthetic materials that is able to draw off water in an efficient manner.

Briefly, the invention is directed to a drainage element comprising a casing that defines an enclosed space and a mass of randomly disposed discrete loose fill elements of light weight material within the casing. In accordance with the invention the loose fill elements are in unconnected free flowing relation to fill the space in the casing. In addition, the casing has a first part-circumferential portion having a plurality of openings therein for passage of water therethrough and a second part-circumferential portion having a porosity to prevent the passage of water therethrough.

In one embodiment, the drainage element may be positioned with the portion with the openings for the passage of water on the top half of the casing while the less porous portion is positioned on the bottom half of the casing to act as a surface along which water may run to exit longitudinally from the drainage element rather than to pass transversely or laterally therethrough.

In another embodiment, the positions of the porous and not as porous portion are reversed so as to preclude passage of water through the top half of the drainage element. This embodiment is particularly useful in a nitrification field where a perforated pipe is disposed within the mass of loose fill material and liquids are to pass from the pipe outwardly through the loose fill and casing. The not as porous top half of the casing then serves to preclude dirt from passing into the loose fill to clog the passageways therein.

In still another embodiment, the not as porous portion of the casing may be made of a silk sock that allows the passage of water but precludes the passage of dirt. This embodiment would be used with the not as porous portion at the top.

In still another embodiment, a drainage element is constructed of an elongated casing of net like material with a mass of randomly disposed discrete and unconnected loose fill elements therein, as above, and a porous layer, such as a polyethylene sheet or film, is disposed over a top surface of the casing. In addition, the layer is secured to the casing along two longitudinal edges thereof and is free of the casing along a central longitudinal portion thereof. The layer is of greater width than the casing to form a pocket or sleeve that allows insertion of a perforated pipe between the layer and the casing.

In this embodiment, the loose fill containing part of the drainage element forms a base for the perforated pipe. Further, the pliable nature of the drainage element is such that the top surface may be deformed into a shape to accommodate the shape of the pipe. In this respect, the loose fill material moves within the casing to accommodate the shape of the pipe.

One advantage of this embodiment is that the drainage element may be shipped separately from the pipe. Installation of the pipe in the sleeve defined by the drainage element may take place in the field just prior to installation.

The loose fill elements are disposed in the container in an unconnected free flowing relation to each other and are of relatively small size to define a large surface area and a large void volume.

Typically, the drainage element may be made by filling a tubular casing or bag of mesh construction with the loose fill elements and of then sealing the mouth of the bag to form a closed unit. The loose fill elements may have a weight of less than 0.5 pounds per cubic foot so that a bag having a size of 15 cubic feet weighs less than 7½ pounds. In addition, the elements have a size that fall in the range of ⅛ inches by ⅛ inches to 2 inches by 2 inches.

The drainage element may be constructed in a tubular shape or in a bale shape. In addition, the drainage element may have a length from 10 feet to 20 feet and a diameter of from 2 feet to 4 feet.

In use, in order to provide a drainage system adjacent a wall, a trench is formed adjacent the wall. Thereafter, one or more tubular drainage elements may be dropped into place in the trench manually with the non-porous portion on the bottom. Thereafter, backfill is provided over the drainage elements in a conventional manner.

The loose fill elements may be made of any suitable materials, such as expended thermoplastic material, wood chips, pieces of chopped rubber tires and the like. Thermoplastic polymer material is particularly useful as elements can be made of generally uniform size. For example, the loose fill element are made by extruding a continuous stream of expanded thermoplastic material of desired cross-sectional block shape and severing the stream into individual elements. As such, each element is of block shape with continuous surfaces. Thus, walls or the like are not formed that might otherwise block water flow or trap water of fines within the element in a conventional have various block letter shapes such as a C-shape, E-shape, S-shape, V-shape or variations thereof. Typically, each of these elements has a tough outer skin that is not permeable to water.

Further, loose fill elements made of expanded polymer are made with a closed cell construction. Accordingly, the elements may be broken to expose an internal surface. However, being of closed cell construction, the exposed internal surfaces are not permeable to water.

Once the drainage elements are in place, water would drain through the drainage elements by flowing along the outer surfaces of the randomly placed loose fill elements to a lowermost area. From there, the water would flow along the not-as-porous portion under gravity to an exit area.

The drainage elements may also be made in cylindrical shape to act as lateral drain pipes for draining water away from the larger drainage elements in a trench adjacent to a retaining wall. In this case, the smaller lateral pipes would be made of the same materials and would be placed in communication with the lowermost areas of the main drainage elements in order to direct water away from the retaining wall to a suitable disposal site, for example, under gravity.

The drainage elements may be deployed in a manner to create a septic tank drainage system. For example, a plurality of relatively large cylindrical drainage elements may be connected to outlets of a septic tank in order to convey fluid from the septic tank for dispersal into the ground surrounding the drainage elements. Additional smaller diameter drainage elements may extend from the main elements to an enlarged field for dispersing fluid from the septic tank.

In another embodiment, a drainage mat may be constructed for use in draining fluids from various underground environments. In this case, the drainage mat is comprised two outer layers, one of which is impervious to water and the other of which is pervious or permeable to water and that is secured to the first layer. In addition, a third layer of discrete loose fill material is disposed between the two outer layers to define a plurality of flow passages therethrough. Such a drainage mat may be employed with the impervious layer at the top so that water may not flow into the mat from above.

The drainage mat may also be fabricated so that the two outer layers are heat sealed to each other in a checker board manner along flattened strips to define a plurality of sub-sections. In this case, each sub-section has discrete loose fill material therein and is flexible to relative to an adjacent sub-section along a respective flattened strip. In this way, the mat may be rolled on itself to facilitate transportation.

One of the advantages of the drainage element is that the drainage element is generally non-compressible. Thus, after a drainage element has been placed in a trench and a suitable back fill place thereover, there will be little or no subsidence of the backfill area over time due to a compression of the drainage elements.

These and other objects and advantages of the invention will become more apparent from the following detailed description taken in conjunction with the accompanying drawings wherein.

Figure 1:
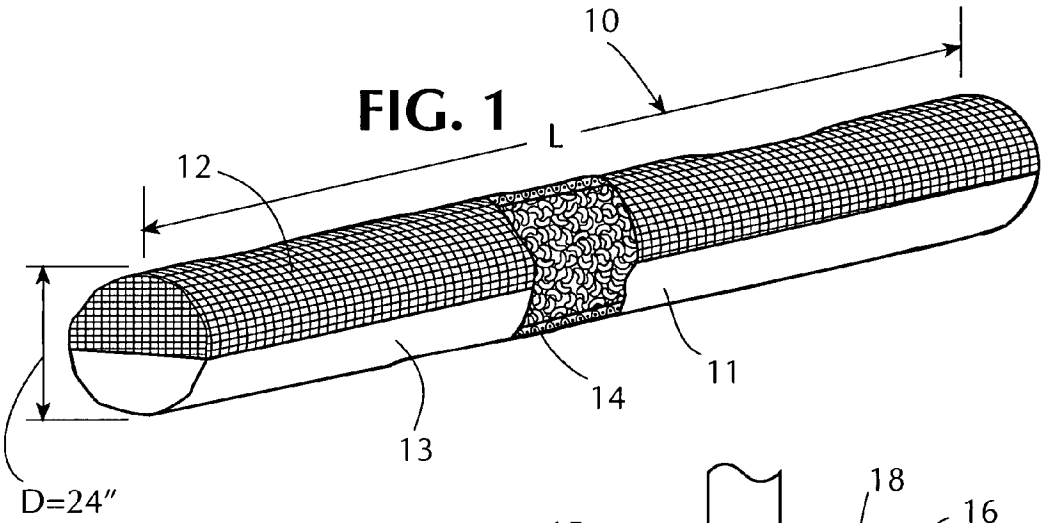
FIG. 1 illustrates a perspective view of a cylindrical drainage element constructed in accordance with the invention.

Referring to FIG. 1, the drainage element 10 is constructed of a casing 11 that defines an enclosed space and has a first part-circumferential portion 12 having a plurality of openings therein for passage of water therethrough into and from the space and a second part-circumferential portion 13 having a porosity to prevent the passage of water therethrough. In addition, the drainage element 10 has a mass of randomly disposed discrete loose fill elements 14 of light weight expanded polymer material within the casing in unconnected free flowing relation to fill the space therein.

The casing 11 is of tubular shape with closed ends to define an enclosed space that confines the mass of loose fill elements 14 therein.

Figure 4:
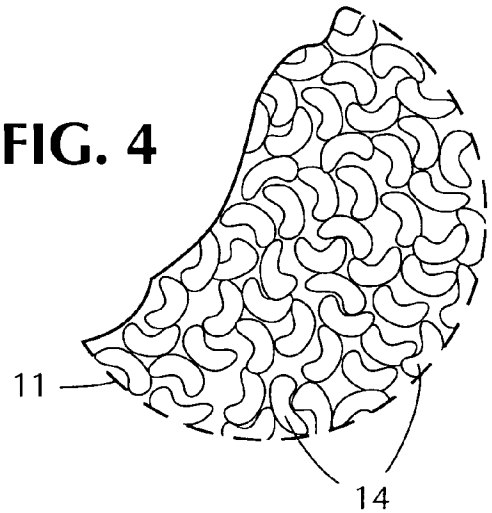
FIG. 4 illustrates a schematic view of the loose fill elements disposed within the drainage element of FIG. 1.

The loose fill elements 14 are disposed within the casing 11 in unconnected relation to each other in order to fill the space within the casing 11. As indicated in FIG. 4, the loose fill elements 14 are of a block letter shape, for example a C-shape or a L-shape. Alternatively, the loose fill elements 14 may be made of any suitable shape such as E-shape, S-shape and the like. The shape of an element 14 is characterized in having a uniform cross-section throughout the extruded length. Thus, recesses are avoided within the element 14 and unobstructed passageways are formed within the element 14. Typically, the loose fill elements have a size less than the size of the openings in the casing and a weight of less than 0.5 pounds per cubic foot and in some cases, less than 0.2 pounds per cubic foot.

The casing 11 may initially be made from a web of netting and a plastic web that are secured together along two longitudinal edges to form a sleeve or tube. In this case, after closing one end of the sleeve to form a bag, the loose fill elements 14 are blown into the bag or deposited, for example, using a machine as described in U.S. Pat. No. 6,035,606. After filling, the open end of the casing (bag) may be sealed in any suitable fashion. For example, where the casing 11 is made of a thermoplastic mesh material and a thermoplastic web, the open end of the bag may be heat sealed into a closed condition. Where the bag is made of other types of material, the closure may be effected by mechanical means, such as by sewing, stapling, crimping or the like.

Figure 5:
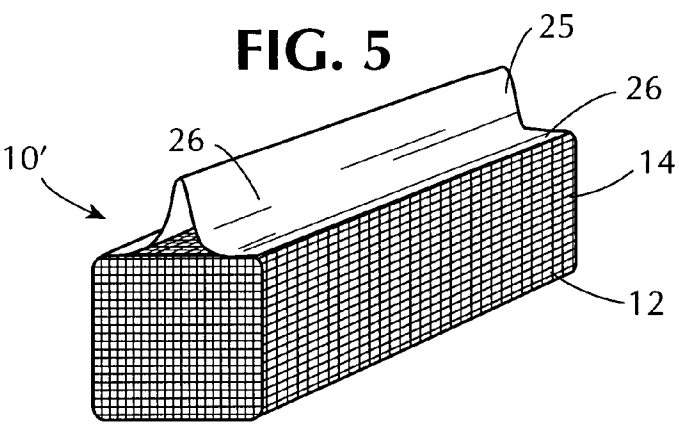
FIG. 5 illustrates a modified bale-like drainage element with a pipe-receiving pocket in accordance with the invention.

Referring to FIG. 5, the drainage element 10' may be made in a bale shape rather than a tubular shape.

The tubular drainage element 10 may be made of any suitable size depending upon the use to which the drainage element is to be subjected. For example, the drainage elements 10 may be made to have a length of from 10 feet to 20 feet and a diameter of from 2 feet to 4 feet.

Figure 2:
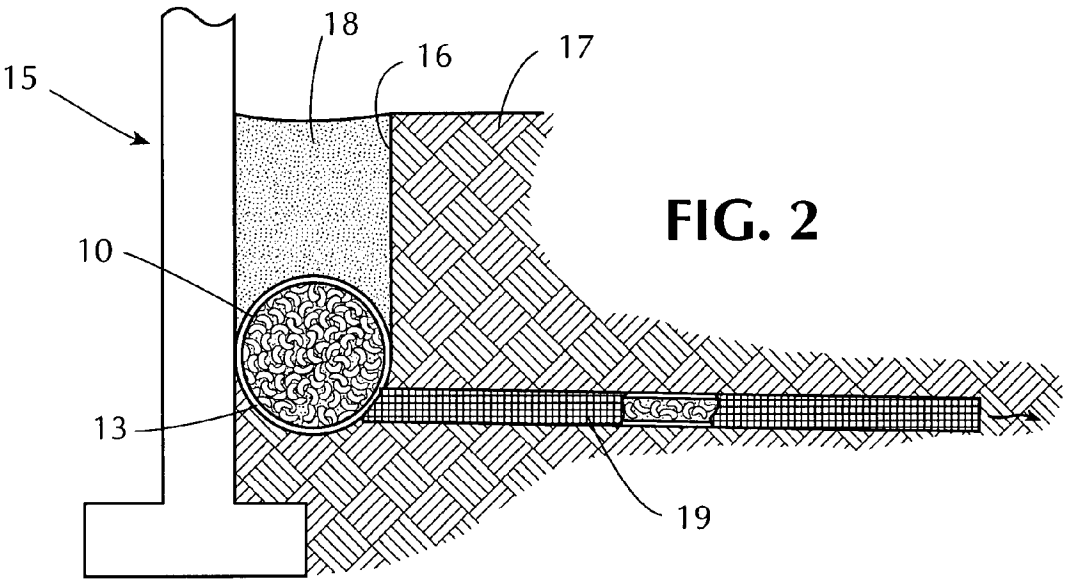
FIG. 2 illustrates a schematic cross-sectional view of a drainage element employed within a trench adjacent a retaining wall in accordance with the inventions.

Referring to FIG. 2, in order to form a drainage system, for example, adjacent to a wall 15, a trench 16 is formed in the ground 17 adjacent to the wall 15 in any conventional manner. Thereafter, one or more drainage elements 10 is manually placed in the bottom of the trench to extend along the wall 15 with the non-porous portion 13 at the bottom. In this respect, the drainage elements 10 are of such a light weight construction that one person is able to carry the drainage element, for example from a delivery truck directly to the trench 16 for placement therein. In addition more than one drainage element may be carried by the same person. In this way, a row of drainage elements 10 may be placed in the trench 16 along the length of the wall 15 or stacked rows of elements 10 may be placed in the trench.

Thereafter, a suitable backfill 18 is filled into the trench 16 over the filled elements 10.

In addition, at least one lateral pipe 19 is disposed adjacent to a lowermost area of the main pipe formed by the drainage element 10. This lateral pipe 19 may be made in the same fashion as the main pipe but of a smaller diameter of the lateral pipe 19 serves to define a flow path for water which is collected within the main pipe 10 and directed away from the wall 15.

Where the ground 17 is of a clay-like water impervious nature, the drainage elements 11, 19 serve as conduits to convey water through the ground 17 to a suitable collection site.

Where the ground 17 is water permeable, the drainage elements 10, 19 serve to disperse water that would otherwise collect adjacent to the retaining wall 15 into the surrounding area away from the wall 15.

In the event that a filled element required replacement after a period of use, replacement may be carried out in a simple manner. To this end, the backfill 18 would be removed and the drainage element 10 simply removed by hand or otherwise. Since the container and the loose fill elements are made of generally non-biodegradable materials, the drainage elements may be removed without the loose fill elements becoming dispersed to the surrounding environment, for example, due to wind or the like. A fresh drainage element may then be placed in the trench and the backfill 18 replaced. Should a series of drainage elements require replacement, the entire trench 15 maybe re-opened in order to remove the drainage elements for replacement purposes.

The drainage element 10 may also be constructed with a bottom half that is not porous. In this case, the top half allows water to pass through but prevents dirt from entering. The bottom half serves as a trough to direct the collected water away.

In this embodiment, the bottom half 13 may be formed of a solid polymer film of black color that is secured to a top half formed of a porous film or web 12 of green color. As such, the drainage element 10 can be readily placed in a trench 16 with the black side down.

By way of example, the bottom half may be formed of an 8 inch wide 3 mil thickness polyethylene sheet with a filter sheet adhered thereto while the top half is formed of a netting that is heat sealed or otherwise secured to the bottom half continuously along two longitudinal edges. The resultant tube may then be filled with free flowing loose fill elements as above described. Obviously, larger sized tubes may be formed. Also, the tubes may be used with the top and bottom halves reversed depending on the desired use of the drainage element 10.

Figure 3:
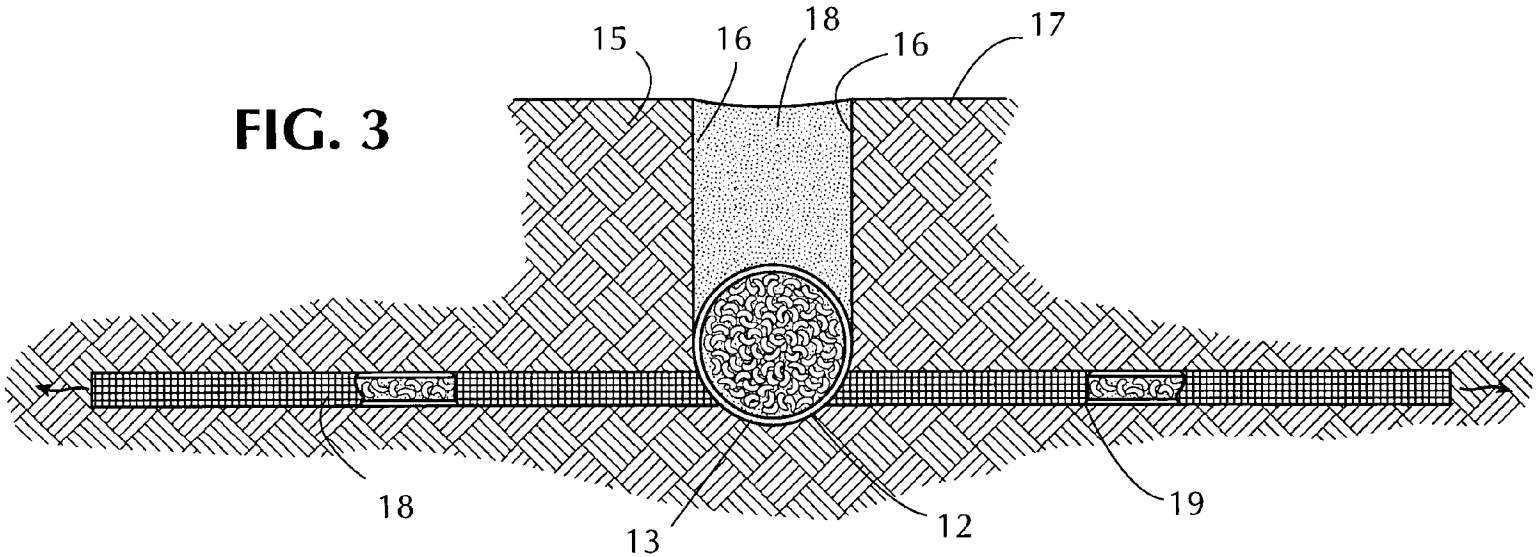
FIG. 3 illustrates a part cross-sectional view of drainage system constructed of a plurality of drainage elements in accordance with the invention.

Referring to FIG. 3, wherein like reference characters indicate like parts above, a drainage system may employ a main pipe formed of a large diameter drainage element 10 and a plurality of lateral pipes 19 formed of smaller diameter drainage elements.

Figure 6:
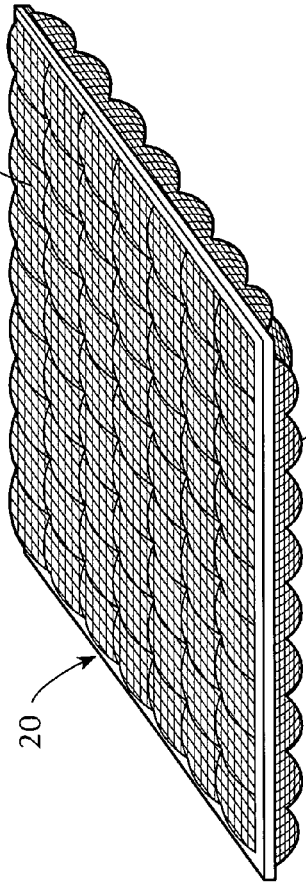
FIG. 6 illustrates a perspective view of a drainage mat constructed in accordance with the invention.

Referring to FIG. 6, a drainage element may be constructed in the form of a mat. In this embodiment, the drainage mat 20 has a bottom layer of plastic film 21 that is impervious to water and a top layer 21' of mesh material which is pervious or permeable to water. In addition, a layer of discrete free flowing loose fill elements is sandwiched between the top and bottom layers to define a plurality of flow passages therethrough. By having the bottom layer 21 made of a water impervious material, water is able to collect within the mat and flow under gravity towards one end of the mat. Alternatively, the mat may be reversed so that the mesh layer 21 is at the bottom depending on the use of the mat.

Typically, the top and bottom layers 21, 21' of the mat 20 are made of materials which may be heat sealed to each other along the outer edges in order to form a rectangular mat.

In addition, the mat may be filled with loose fill elements in a manner similar to the above. In this case, the top and bottom layers 21, 21' would be sealed to each other along three sides so that a mass of loose fill elements may be sandwiched there between through the open side. Thereafter, the open side would be heat sealed to confine the loose fill elements in flights. In addition, the top and bottom layers may be heat sealed to each other in a checker board manner along flattened strips to define a plurality of sub-sections. For example, the two layers 21, 21' may be heat sealed in an 18 inch grid or a 3 foot by 3 foot grid. Alternatively, the top and bottoms layers may be heat sealed to each other in strip form. The mat 19 may have a thickness of from 1 inch to 18 inches depending on the use of the mat.

The heat sealing of the top and bottom layers 21, 21' of the mat 20 in a grid like manner allows each sub-section to be flexible relative to an adjacent sub-section. In this way, a mat may be rolled on itself into a cylinder for ease of transportation.

Figure 7:
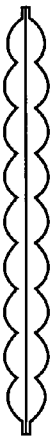
FIG. 7 illustrates an end view of the mat of FIG. 6.

As indicated in FIG. 7, the formation of sub-sections in the mat allows a plurality of mats to be stacked one on top of each other in a parallel manner without sliding of the mats relative to each other.

Figure 8:
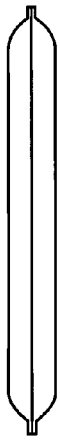
FIG. 8 illustrates an end view of a modified mat constructed in accordance with the invention.

Alternatively, as indicated in FIG. 8, a mat may be formed without a checker board pattern of sub-sections. In this case, however, a stack of mats would be slidable relative to each other.

Figure 9:
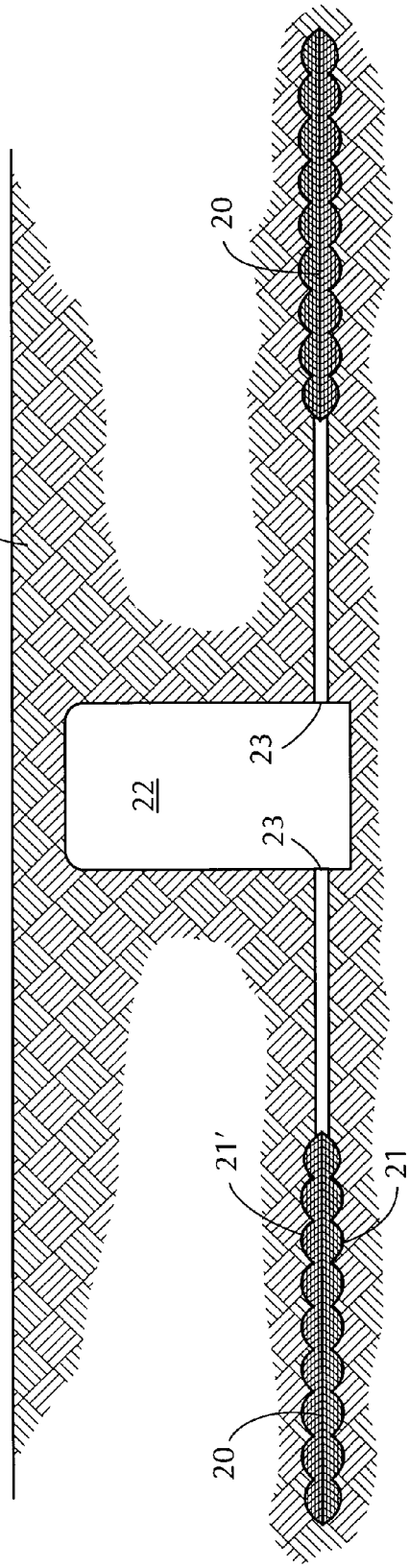
FIG. 9 illustrates a cross-sectional view of a drainage system for a septic tank in accordance with the invention.

Referring to FIG. 9, the drainage elements may be used to provide a drainage system, for example for a septic tank 22. For example, for a septic tank 22 having a plurality of outlet pipes 23 disposed under ground 24, a plurality of mats 20 may be used. As indicated, each mat 19 would be disposed at the terminal end of an outlet pipe 23 from the septic tank 22. Each mat 19 would be placed in the ground 24 with the water impervious layer 20 as the top layer while the layer of mesh material becomes the bottom layer. Such a mat may, for example, be 5 feet×5 feet×4 inches As fluid drains from the septic tank 22 into an outlet pipe 23, the fluid is dispersed through the mat 20 into the ground below the mat 20. At the same time, the water impervious top layer 21' prevents water from flowing into the mat 20 from the ground above.

Typically, the mat 20 is made with a pre-measured amount, for example, 10 cubic feet, of loose fill material that is blown into the mat through a 12 inch opening in the mat. This opening is thereafter heat sealed. Next, the result in bag is vibrated in order to level out the loose fill elements within the bag. Next, the bag is subjected to a press treatment in which the film on one side is heat sealed to the mesh on the opposite side to form a checker board pattern of 18 inch×18 inch to form a quilted construction.

Quilting of the pads facilitates storage in stacking. However, quilting may be omitted, however, the resulting smooth sides of the pads would allow the pads to slide relative to one another.

Referring to FIG. 5, the bale shaped drainage element 10' is constructed of as above with a lower non-porous half 13, a porous upper half 12 and a mass of randomly disposed discrete and unconnected loose fill elements 14 therein. In addition, a porous layer 25, for example a sheet or film made of one of the group consisting of polyethylene, polypropylene, polyvinyl and polystyrene, is disposed over a top surface of the element 10'. This layer 25 is secured to the element 10' along two longitudinal edges 26 thereof and is free of the element 10' along a central longitudinal portion thereof. The layer 25 is of greater width than the element 10' to form a pocket or sleeve that allows insertion of a perforated pipe (not shown) between the layer 25 and the element 10'.

In this embodiment, the loose fill containing part of the drainage element 10' forms a base for the perforated pipe. Further, the pliable nature of the drainage element is such that the top surface may be deformed into a shape to accommodate the shape of the pipe. In this respect, the loose fill material moves within the casing 11 to accommodate the shape of the pipe.

One advantage of this embodiment is that the drainage element 10' may be shipped separately from the pipe. Installation of the pipe in the sleeve defined by the drainage element may take place in the field just prior to installation.

Alternatively, the layer 25 may be a non-porous layer to preclude water flow therethrough. Also, the layer 25 may be secured to the non-porous portion 12 of the drainage element 10' and the drainage element 10' installed upside down.

The invention thus provides a drainage element of simple construction that may readily replace crushed stone or gravel in a drainage system.

Further, the invention provides a filled element which can be readily constructed of simple materials and which may be easily transported from place to place.

For example, the drainage elements may be fabricated as cylindrical drainage elements that can be transported, for example by the truckload from a remote fabrication site to a construction site. A filled element may then be unloaded manually and carried manually to a trench adjacent to a retaining wall, foundation wall, basement wall, or the like. After placements, back filling operations may be carried out in the usual fashion.

It has been found that bags of loose filled material are generally non-compressible.

Since the drainage elements act as their own drainage pipes, there is no need to install perforated pipes of conventional structure in the trench along with the drainage elements.

Further since the loose film elements of a drainage element are not connected to each other, a drainage element may be manipulated to fit into a space which may be other than perfectly cylindrical. That is to say, the drainage element may be somewhat deformed to fit into a space that is other than cylindrical or cubic. In these cases, the individual elements migrate within a container to adapt to the shape of the environment into which the drainage element is placed. Once in place, and back filled, the drainage element retains the deformed shape and remains non-compressible. Thus, whereas perforated pipe requires care in being placed on a smooth surface such as a sand bed, the drainage elements of the invention may be placed on non-smooth surfaces. For example, small pieces of stone, brick or other debris will not interfere with the structural integrity of the purposes of the drainage element.

What is claimed is:

1. A drainage element comprising a casing defining an enclosed space and having a first part-circumferential portion having a plurality of openings therein for passage of water therethrough into and from said space and a second part-circumferential portion having a porosity to prevent the passage of water therethrough; and a mass of randomly disposed discrete loose fill elements of light weight expanded polymer material within said casing in unconnected free flowing relation to fill said space therein.

2. A drainage element as set forth in claim 1 wherein said openings of said casing are of a size less than the size of said loose fill elements to retain said loose fill elements therein.

3. A drainage element as set forth in claim 2 wherein said casing is of elongated cylindrical shape.

4. A drainage element as set forth in claim 2 wherein said casing is of elongated bale shape.

5. A drainage element as set forth in claim 2 wherein said casing is of mat shape.

6. A drainage element as set forth in claim 1 wherein said loose fill elements have a weight of less than 0.5 pounds per cubic foot.

7. A drainage system comprising a main pipe for receiving a flow of fluid, said main pipe including a mass of randomly disposed discrete and unconnected loose fill elements defining a plurality of flow passages therethrough and an elongated casing having said mass of loose fill elements confined therein, said casing having a first part-circumferential portion having a plurality of openings therein for passage of water therethrough into and from said space and a second part-circumferential portion having a porosity to prevent the passage of water therethrough; and a plurality of lateral pipes extending from said main pipe for conveying a flow of fluid therefrom, each said lateral pipe including a mass of randomly disposed discrete loose fill elements defining a plurality of flow passages therethrough and an elongated casing having said mass of loose fill elements confined therein, said casing having a first part-circumferential portion having a plurality of openings therein for passage of water therethrough into and from said space and a second part-circumferential portion having a porosity to prevent the passage of water therethrough.

8. A drainage system as set forth in claim 7 wherein said first part-circumferential portion is disposed on a bottom half of said casing.

9. A drainage system as set forth in claim 7 wherein said first part-circumferential portion is disposed on a top half of said casing.

10. A wall drainage system comprising a trench adjacent a wall;

at least one elongated drainage element disposed in and along a bottom of said trench, said drainage element including a mass of randomly disposed discrete and unconnected loose fill elements of light weight expanded polymer material defining a plurality of flow passages therethrough; and a casing enclosing said mass and having a first part-circumferential portion having a plurality of openings therein for passage of water therethrough and a second part-circumferential portion having a porosity to prevent the passage of water therethrough;

a layer of backfill disposed over and on said drainage element.

11. A drainage system as set forth in claim 10 wherein said wherein said second part-circumferential portion is disposed on a bottom half of said casing.

12. A drainage system as set forth in claim 11 which further comprises at least one pipe extending from said drainage element for conveying water therefrom, said pipe including a mass of discrete and unconnected loose fill elements of light weight material defining a plurality of flow passages therethrough; and a casing enclosing said mass and having a first part-circumferential portion having a plurality of openings therein for passage of water therethrough and a second part-circumferential portion having a porosity to prevent the passage of water therethrough.

13. A drainage system as set forth in claim 12 which further comprises a layer of backfill over and on said pipe.

14. A drainage system as set forth in claim 10 wherein said drainage element is non-compressible under the weight of said backfill.

15. A drainage system as set forth in claim 10 wherein said loose fill elements have a weight of less than 0.5 pounds per cubic foot.

* * * * *